US005902174A

United States Patent [19]

Jono

[11] Patent Number: 5,902,174

[45] Date of Patent: May 11, 1999

[54] SELF-DRIVE BLAST APPARATUS

[75] Inventor: Shuzo Jono, Higashiosaka, Japan

[73] Assignee: U-Technology Co., Ltd., Higashiosaka, Japan

[21] Appl. No.: 08/849,184

[22] PCT Filed: Sep. 25, 1996

[86] PCT No.: PCT/JP96/02748

§ 371 Date: May 28, 1997

§ 102(e) Date: May 28, 1997

[87] PCT Pub. No.: WO97/12725

PCT Pub. Date: Apr. 10, 1997

[30] Foreign Application Priority Data

Sep. 29, 1995 [JP] Japan ..... 7-252678

[51] Int. Cl.[6] ..... B24B 3/06

[52] U.S. Cl. ..... 451/92; 451/38; 451/39

[58] Field of Search ..... 451/92, 38, 39

[56] References Cited

U.S. PATENT DOCUMENTS

| | | | |
|---|---|---|---|
| 4,029,164 | 6/1977 | Urakami | 451/92 |
| 4,934,475 | 6/1990 | Urakami | 451/92 |
| 5,588,900 | 12/1996 | Urakami | 451/92 |

FOREIGN PATENT DOCUMENTS

| | | | |
|---|---|---|---|
| 401301064 | 12/1989 | Japan | 451/92 |
| 401301065 | 12/1989 | Japan | 451/92 |
| 401301066 | 12/1989 | Japan | 451/92 |
| 405104441 | 4/1993 | Japan | 451/92 |
| 6-53382 | 7/1994 | Japan . | |

*Primary Examiner*—Robert A. Rose
*Assistant Examiner*—George Nguyen
*Attorney, Agent, or Firm*—Rosenthal & Osha L.L.P.

[57] ABSTRACT

A self-drive blast apparatus in accordance with the present invention surrounds a area wherein two wall surfaces intersect at a specified angle, to form a substantially sealed space between the apparatus and the wall surfaces, and the body of the blast apparatus adheres by suction onto the wall surfaces by reducing the pressure in the space, so that the apparatus can move along the two wall surfaces and conduct blast cleaning by projecting blast material onto the wall surfaces. The apparatus is capable of moving along the wall surfaces in retaining suction-adhered condition by driving wheels held in positions generally perpendicular to the corresponding wall surface. And, while the apparatus is moving, a blast cleaning process is performed on the wall surfaces in the space. The projected blast material, the dirt removed by the blast material, and the like are blown up in the space and recovered through a depressurization path by the air which introduced into the space during the depressurization of the space.

2 Claims, 7 Drawing Sheets

SELF-DRIVE BLAST APPARATUS

TECHNICAL FIELD

The present invention relates to a self-drive blast apparatus which is capable of moving along wall surfaces while retaining suction-adhered condition onto the wall surfaces.

BACKGROUND ART

As is widely known, a considerable difficulty is involved in conducting by manual works, such kind of works as the cleaning and the conditioning of the substrate surface prior to painting of the inner and outer wall surfaces, in a ship, high-rise building, huge tank, or the like. For this reason, automating those works without relying on manual works has been studied, and various apparatus for the automation have been proposed.

For example, Japanese Examined Patent Publication No. Sho 60-28715 discloses an apparatus which adheres onto a wall surface and moves along the wall surface, wherein the apparatus basically comprising a pressure-receiving body, wheels for driving an apparatus body, seal for defining a depressurized space in cooperation with the pressure-receiving body and with the outer wall surface, and a depressurization source for discharging fluid from the depressurized space. Also, Japanese Examined Patent Publication No. Sho 60-26752 discloses an apparatus comprising, in addition to that basic arrangement, a mechanism for blast cleaning by projecting blast material onto a wall surface which the apparatus suction-adheres onto and moves along.

In these conventional apparatus, for the purpose of moving the apparatus along a wall surface, a space defined by a casing as the pressure-receiving body and the wall surface is depressurized, while to the casing is attached a seal member which is made of a substantially unbreathable and pliable material, and through the seal member the casing closely adheres to the wall surface. The apparatus adheres by suction onto the wall surface by reducing the pressure within the substantially sealed space between the apparatus and the wall surface lower than the pressure outside the apparatus. While maintaining the suction-adhered condition, the apparatus moves along the wall surface with driving wheels coupled to the apparatus. The apparatus is capable of conducting blast cleaning, for example, by projecting blast material onto the wall surface along which the apparatus moves.

By the way, in conducting such works as the cleaning and the conditioning of the substrate surface prior to painting of the inner and outer wall surfaces, in a ship, high-rise building, huge tank, or the like, it is known that a difficulty is involved in the works in a corner where two wall surfaces intersect at a specified angle. The conventional apparatus, however, have not been capable of dealing with a corner where two wall surfaces intersect each other at a specified angle, though the apparatus are capable of dealing with one wall surface (which is typically a flat one).

It is a primary object of the present invention to provide a self-drive blast apparatus which is capable of moving along two wall surfaces which intersect at a specified angle while keeping suction-adhered onto the wall surfaces, and capable of conducting and blast cleaning by injecting blast material onto an portion wherein the two wall surfaces intersect and the vicinity thereof.

DISCLOSURE OF THE INVENTION

In order to achieve the above mentioned object, a self-drive blast apparatus according to a first aspect of the invention is characterized in comprising a casing which defines a space between the casing and two wall surfaces intersecting each other at a specified angle, a seal member which is attached to the circumferential portion of the casing to seal airtightly between the circumferential portion of the casing and the two wall surfaces, a depressurization path in which one end opens into the space and in which the other end side communicates with a depressurizing apparatus, an blast material nozzle which is mounted to the casing and in which one end faces the wall surfaces in the space and the other end side is connected to an apparatus for supplying blast material, and moving means which is capable of moving the casing along the two wall surfaces in the condition of the space being depressurized through the depressurization path by the activation of the depressurizing apparatus.

Further, a self-drive blast apparatus according to a second aspect of the invention is characterized in the moving means comprises wheel members for rolling on the wall surfaces and motors for driving and rotating the wheel members.

Furthermore, a self-drive blast apparatus according to a third aspect of the invention is characterized in further comprising vents for, during the depressurization of the space, allowing air to flow in toward an area where the two wall surfaces intersect each other.

Furthermore, a self-drive blast apparatus according to a fourth aspect of the invention is characterized in the angle of the projecting nozzle can be adjusted so that the projecting direction of blast material is altered.

The self-drive blast apparatus according to the invention operates as follows.

In the self-drive blast apparatus according to the first aspect of the invention, the casing surrounds a part of the area where the two wall surfaces intersect at a given angle and defines the space between the wall surfaces and the casing, and the seal member attached to the circumferential portion of the casing seals airtightly between the casing and the two wall surfaces. In the condition of the space being depressurized via the depressurization path, the blast cleaning is conducted by projecting blast material onto the wall surfaces in the space through the blast material nozzle, while the casing moves along the two wall surfaces with the moving means provided in the apparatus.

Further, in the self-drive blast apparatus according to the second aspect of the invention, the wheels are held in positions generally perpendicular to the corresponding wall surface and the apparatus body is capable of moving along the two wall surfaces intersecting at a specified angle.

Furthermore, in the self-drive blast apparatus according to the third aspect of the invention, the air which flows into the space, during the depressurization of the space, blows up the blast material, the dirt scrubbed and removed by the blast material, or the like, which has collected in the corner between the two wall surfaces intersecting each other at a specified angle, so that the projected blast material can be efficiently sucked up.

Furthermore, in the self-drive blast apparatus according to the fourth aspect of the invention, the blast material nozzle guides the blast material passing through the nozzle to set a projecting direction of the blast material onto the wall surfaces. The angle of the projecting direction of the blast material nozzle can be adjusted and therefore the area of the wall surfaces which can be blasted and cleaned is enlarged by altering the projecting direction during the projection of blast material.

BEST MODE FOR CARRYING OUT THE INVENTION

Embodiments of the invention will now be described in detail with reference to the accompanying drawings.

An apparatus in accordance with the embodiments is a self-drive blast apparatus (hereinafter referred to as "blasting apparatus" or simply as "apparatus," as necessary) which moves along two wall surfaces 1 and 2 intersecting at a specified angle (e.g., at generally right angles, in the embodiments) while retaining suction-adhered condition onto a corner portion between the two wall surfaces 1 and 2, in order to blast by projecting blast material.

Figure 1:
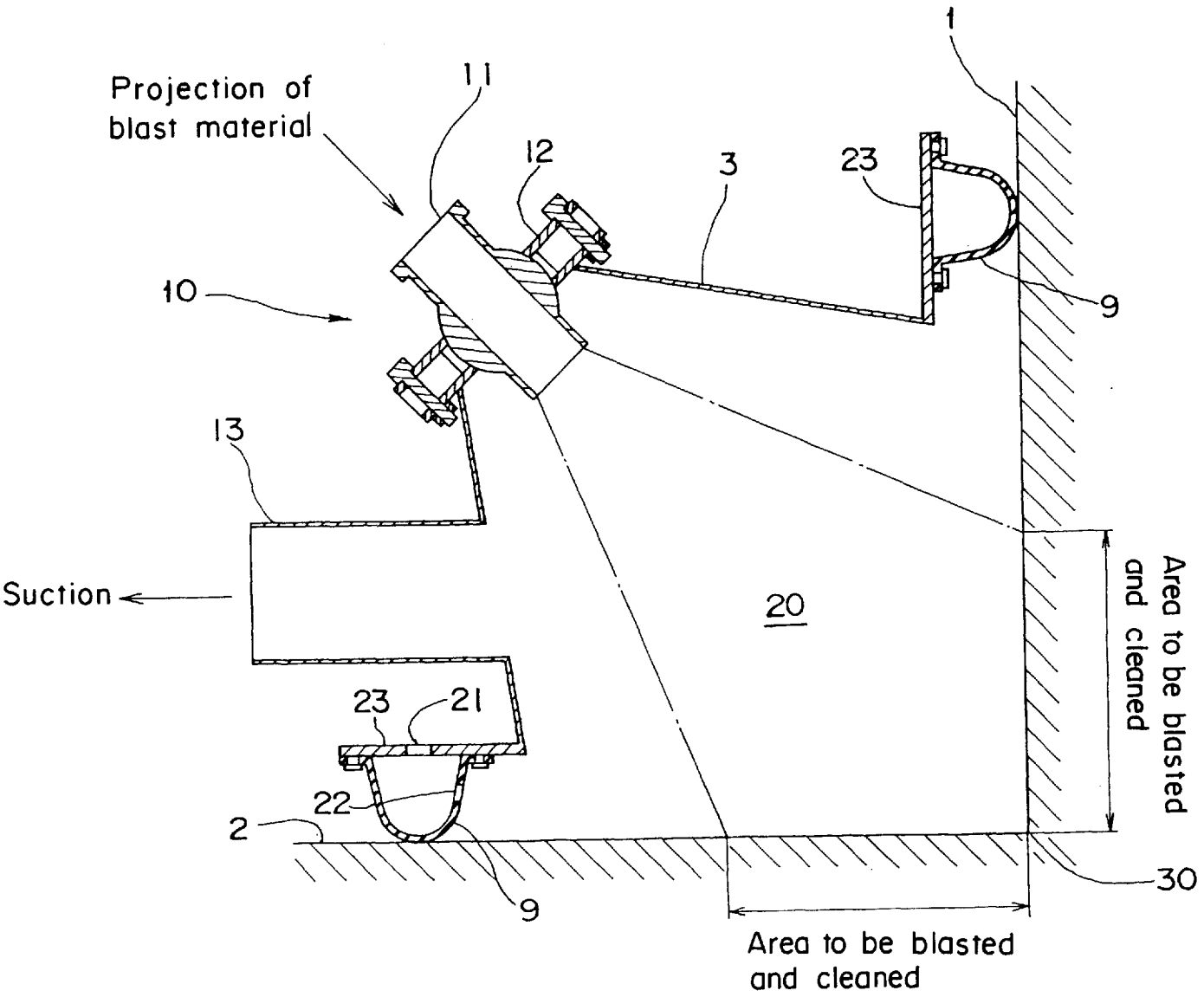
FIG. 1 is a partially sectional view illustrating a self-drive blast apparatus in accordance with an embodiment of the invention.

In FIG. 1 is illustrated a manner in which a blast apparatus 10 in accordance with an embodiment of the invention adheres by suction onto an area where the wall surfaces 1 and 2 intersect at generally right angles. And, in FIGS. 2, 3, and 4, the apparatus 10 disposed in a corner portion between the wall surfaces 1 and 2 is illustrated.

The blast apparatus 10 comprises a casing 3 which defines a space 20 between itself and the two wall surfaces 1 and 2 intersecting each other at generally right angles, and a seal member 9 which is attached to the circumferential portion of the casing 3 to seal airtightly between the circumferential portion of the casing 3 and the two wall surfaces 1, 2. Further, in the apparatus 10, a depressurization path 13 in which one end opens into the space 20 and in which the other end side communicates with a depressurizing apparatus is attached to the casing 3. The apparatus 10 further comprises an blast material nozzle 11 in which one end faces the wall surfaces in the space 20 and in which the other end side is connected to an apparatus for supplying blast material, and comprises wheel members 5, 6, 7, and 8 capable of moving the casing 3 along the two wall surfaces 1, 2, in the condition of the space 20 being depressurized through the depressurization path 13 by the activation of the depressurizing apparatus.

Figure 3:
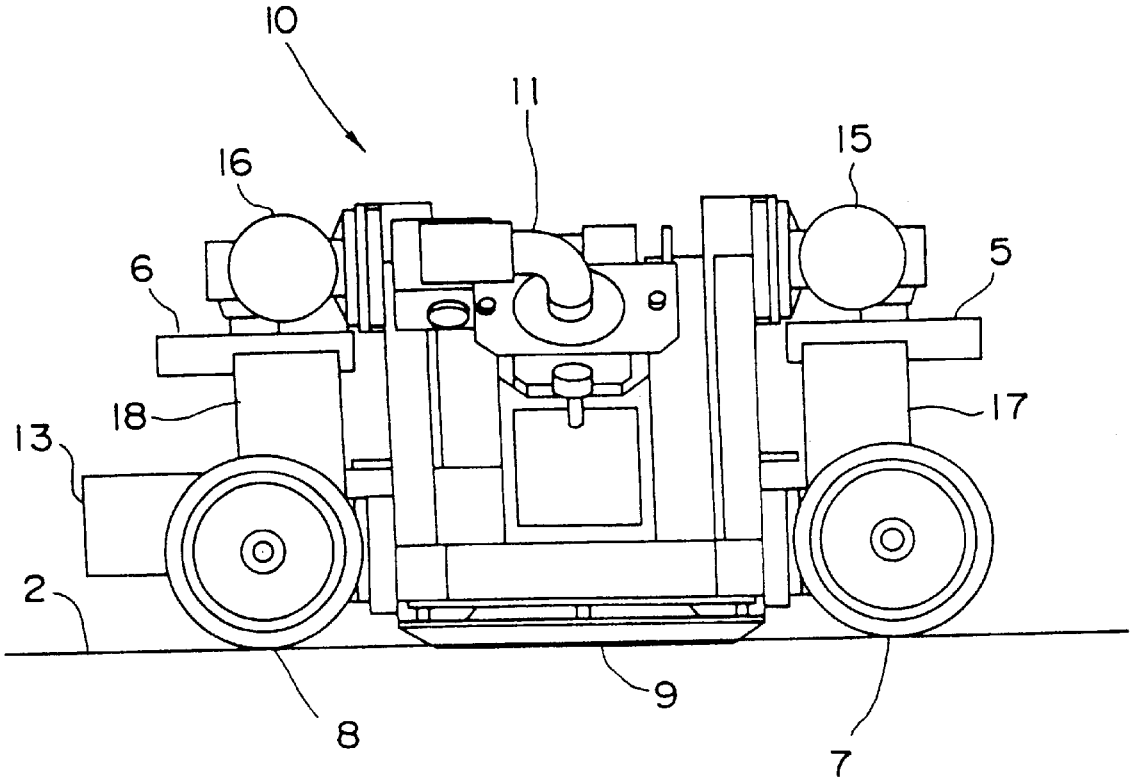
FIG. 3 is a plan view illustrating the blast apparatus.
Figure 4:
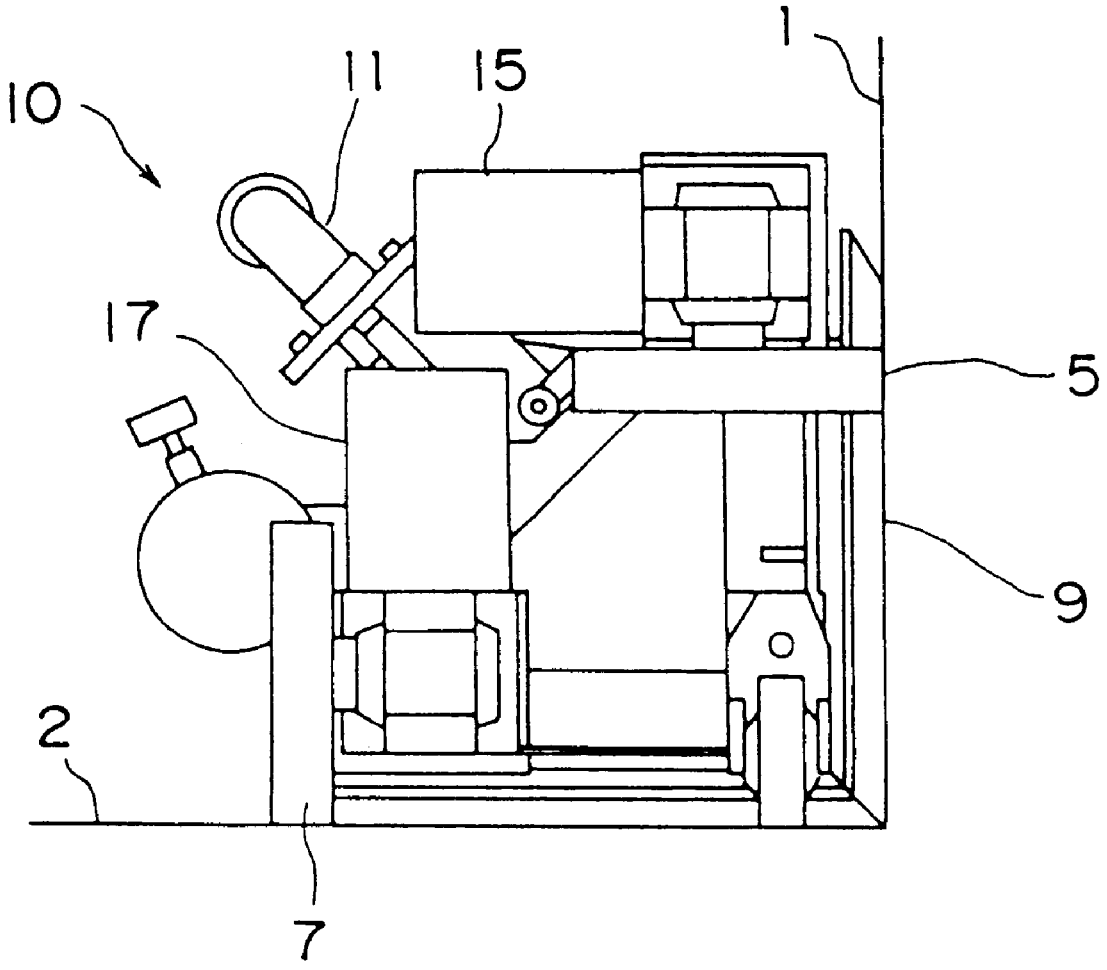
FIG. 4 is a side view illustrating the blast apparatus.

FIG. 3 and FIG. 4 are a plan view and a side view, respectively, of the blast apparatus 10. The apparatus 10 is placed so as to straddle a corner portion between the two wall surfaces 1 and 2, which intersect each other at generally right angles, with the intermediation of the seal member 9 attached to the circumferential portion of the casing 3. As shown in the drawings, the wheel members 5, 6, 7, and 8 are held in positions generally perpendicular to the corresponding one of the wall surfaces 1, 2 so as to rotate on the corresponding wall surface. In the apparatus 10, a driving motor is provided for each wheel member, and the wheel members 5, 6, 7, and 8 are driven and rotated by the driving motors 15, 16, 17, and 18, respectively. In the embodiment, for the purpose of allowing the apparatus 10 to move while keeping suction-adhered condition onto the wall surfaces, the driving forces for the wheel members 5, 6, 7, and 8 which are driven by the driving motors are predetermined so that the frictional forces exerted between the two wall surfaces 1, 2 and the wheel members 5, 6, 7, 8 are larger than the frictional forces exerted between the two wall surfaces 1, 2 and the seal member 9.

Figure 2:
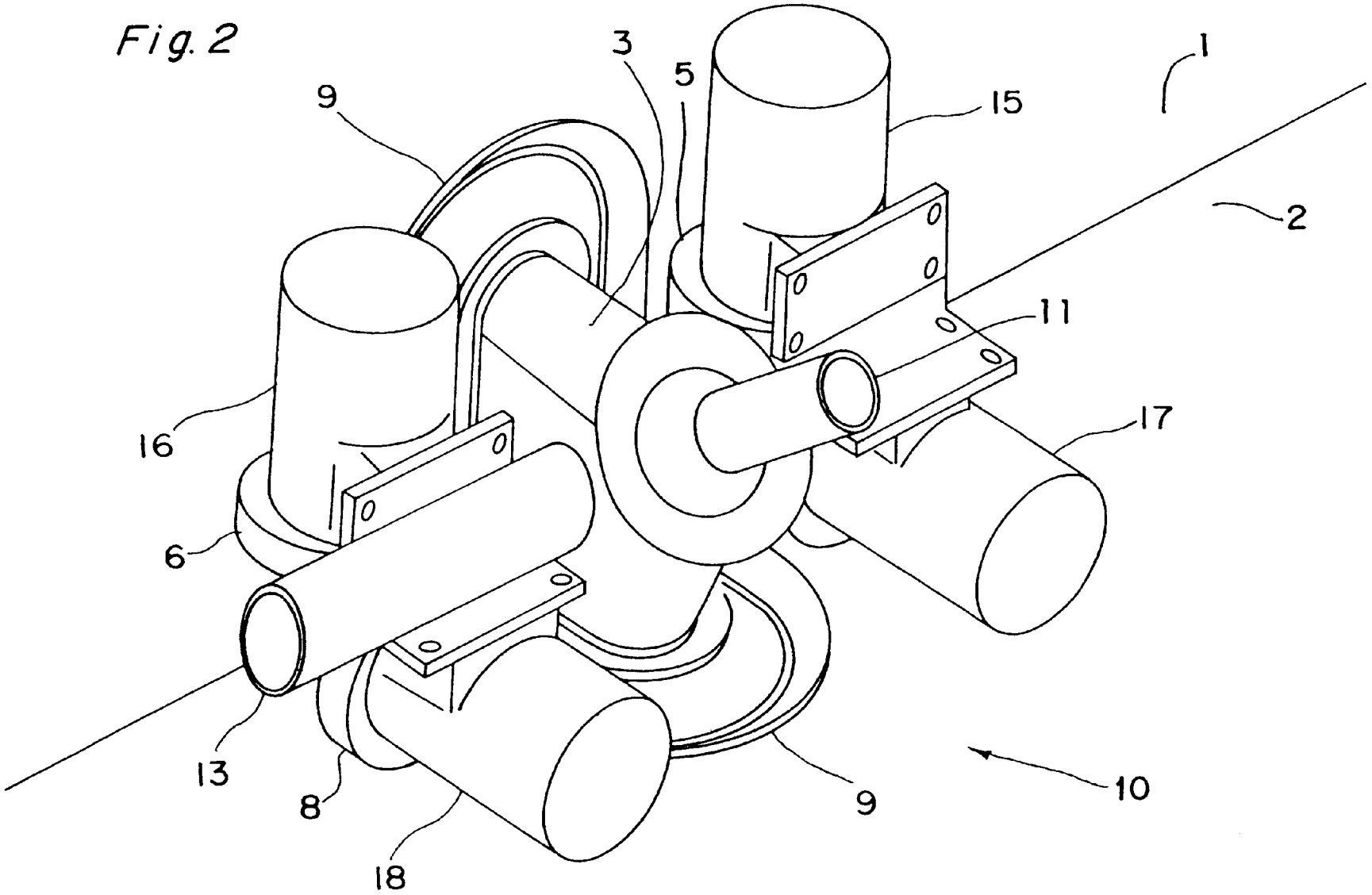
FIG. 2 is a perspective view illustrating the blast apparatus.

As shown in FIG. 2, the casing 3 is provided with the blast material nozzle 11, from which the blast material is projected onto the wall surfaces in the space 20. A portion of the surface of the blast material nozzle 11 is spherical-shaped and a holder 12 holding and supporting the spherical portion has a constitution which allows the angle of the blast material nozzle 11 to be adjusted. In the apparatus 10, for the purpose of ensuring the airtightness between the blast material nozzle 11 and the holder 12, the contact surfaces between both the members are sealed. The casing is also provided with the depressurization path 13 communicating with the depressurizing apparatus (not shown). In the embodiment, the depressurizing apparatus not only depressurizes the space 20 but, by the sucking action, sucks up and retrieves through the depressurization path 13 the blast material which has been projected from the blast material nozzle 11 into the space 20.

In FIG. 1 is illustrated a manner in which the blast apparatus 10 in accordance with the embodiment of the invention adheres by suction to an area where the wall surfaces 1 and 2 intersect at generally right angles. The apparatus 10 is initially placed so as to define the space 20 between the casing 3 and the two wall surfaces 1, 2 intersecting at generally right angles. In the apparatus 10, the seal member 9 has a shape which allows the member 9 to adhere closely to a corner 30 between the two wall surfaces 1 and 2 generally perpendicular to each other. The depressurization of the space 20 by the depressurizing apparatus communicating with the depressurization path 13 permits the apparatus 10 to adhere by suction onto both the wall surfaces 1 and 2. In the suction-adhered condition, the blast material which has been accelerated with compressed air is projected toward the corner 30 of the wall surfaces through the blast material nozzle 11 provided on the casing 3. The wall surfaces undergo cleaning or processes for painting by the collision of the blast material with the wall surfaces. As the blast material, for example, steel grit of 0.5 to 0.7 mm $\phi$ has been used.

The blast material which has collided with the wall surfaces is then recovered by the sucking action of the depressurizing apparatus through the depressurization path 13. At this time, some blast material splashes over the corner 30 between the two wall surfaces in the space 20 after colliding with the wall surfaces; in this corner portion is thus prone to collect the blast material, the dirt removed by the blast material, or the like, which would affect the efficiency of the works.

For this reason, the blasting apparatus 10 in accordance with the embodiment is provided with, for example, air vents 21, 22, so that air flows, through the seal member 9 which is in contact with the wall surface 2, into the space 20 toward the area where the two wall surfaces intersect each other, by the pressure difference between the space and the outside of the apparatus. Providing such vents 21, 22, the air which flows into the space 20 through the vents 21,22 being provided in a flange 23 for attaching the seal member of the casing 3 and on the side facing the space of the seal member 9, blow up the blast material which has collided, the dirt removed by the abrasive material, or the like in the space, thereby causing the retrieval through the depressurization path 13 to be done smoothly. The retrieved blast material is recycled and reused.

As opposed to the depressurization of the space by the depressurizing apparatus, the supply of blast material and the introduction of air increase the pressure in the space; in the embodiment, the conditions of the supply and the influx are predetermined respectively so that the supply and the influx may not hinder the adhesion by suction of the apparatus body to the wall surfaces.

Figure 5:
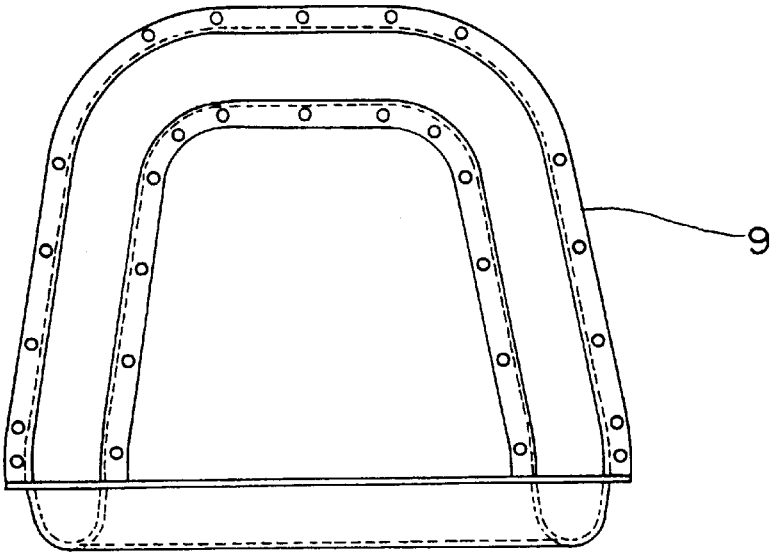
FIG. 5 is a plan view illustrating a seal member attached to the blast apparatus.
Figure 6:
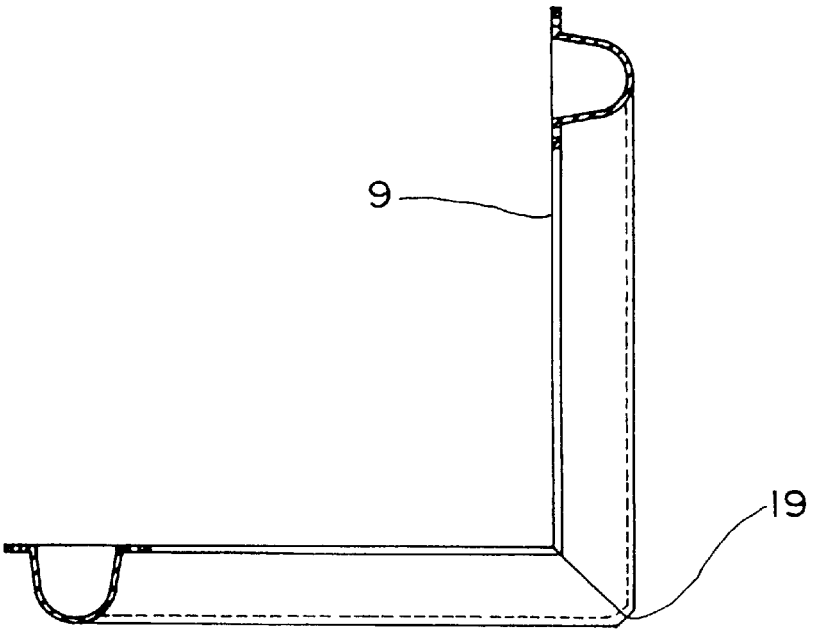
FIG. 6 is a side view illustrating the seal member.

In FIGS. 5 and 6 is illustrated the seal member 9 having an L-shape in side view in accordance with the embodiment; even with respect to two wall surfaces intersecting at generally right angles, forming the seal member 9 in such a shape allows a corner 19 of the seal member 9 to be in sufficiently intimate contact with the corner 30 between the wall surfaces.

Figure 7:
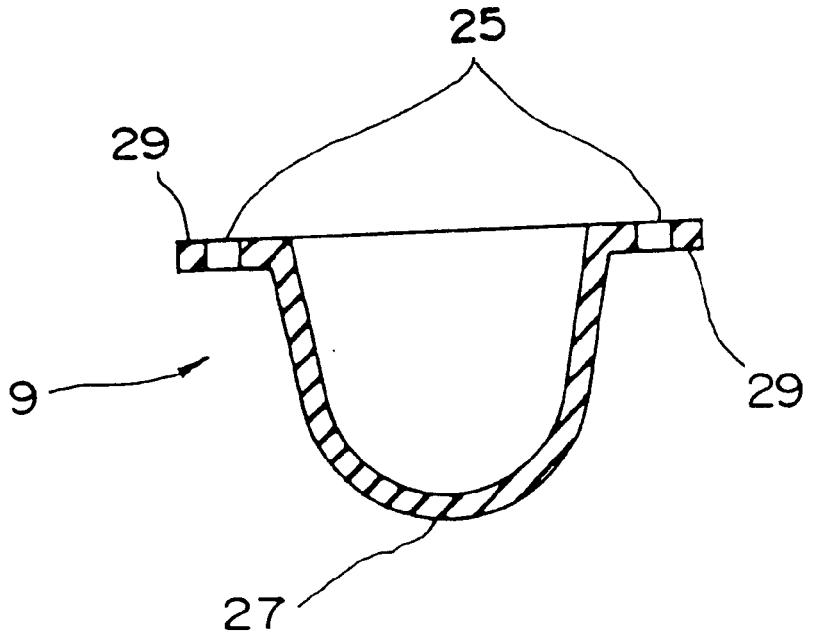
FIG. 7 is a sectional view illustrating the seal member.

FIG. 7 is a sectional view of the seal member 9; as shown in this figure, a semicircular section is employed so as to reduce the influence of the outside-air pressure exerted during the depressurization of the space and the influence of a frictional force exerted in the movement of the apparatus. The seal member having such a shape, does not curl up toward the space 20, and is capable of sufficiently preventing the outside air from penetrating. Both the ends of the semicircle are provided with a mounting flange 23 which has openings 25 spaced apart. Via the openings 25, the seal member 5 is attached to the casing 3.

The seal member 9 is made of an unbreathable, pliable material, and the contact of the seal member with the wall surfaces thus grows tighter as the space 20 is depressurized. Even in the case of wall surfaces having microscopic roughness, a bulging portion 21 of the seal member is capable of adhering closely onto the wall surfaces while flexibly accommodating the asperities, thus ensuring a sufficient sealing.

Figure 8:
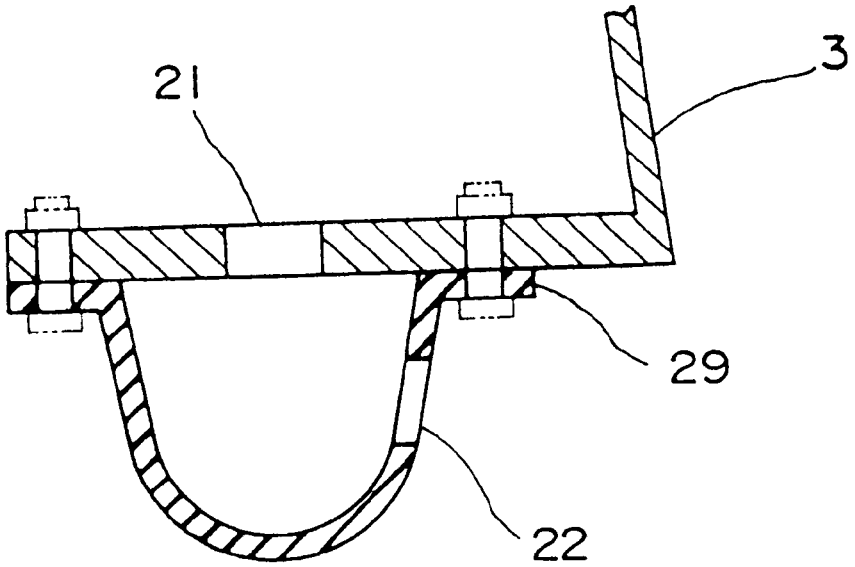
FIG. 8 is a sectional view illustrating a portion of the seal member having air vents, where the seal member is attached to a casing.

In FIG. 8 is illustrated a section of the attaching portions of the casing 3 and the seal member 9, the portions having the vents 21, 22 for the air for blowing up into the sealed space the blast material which has collided with the wall surfaces, as described above. As shown in the drawing, the air vents 21, 22 are provided in the flange 23 for attaching the seal member of the casing and on the surface of the seal member on the side of the space.

Figure 9:
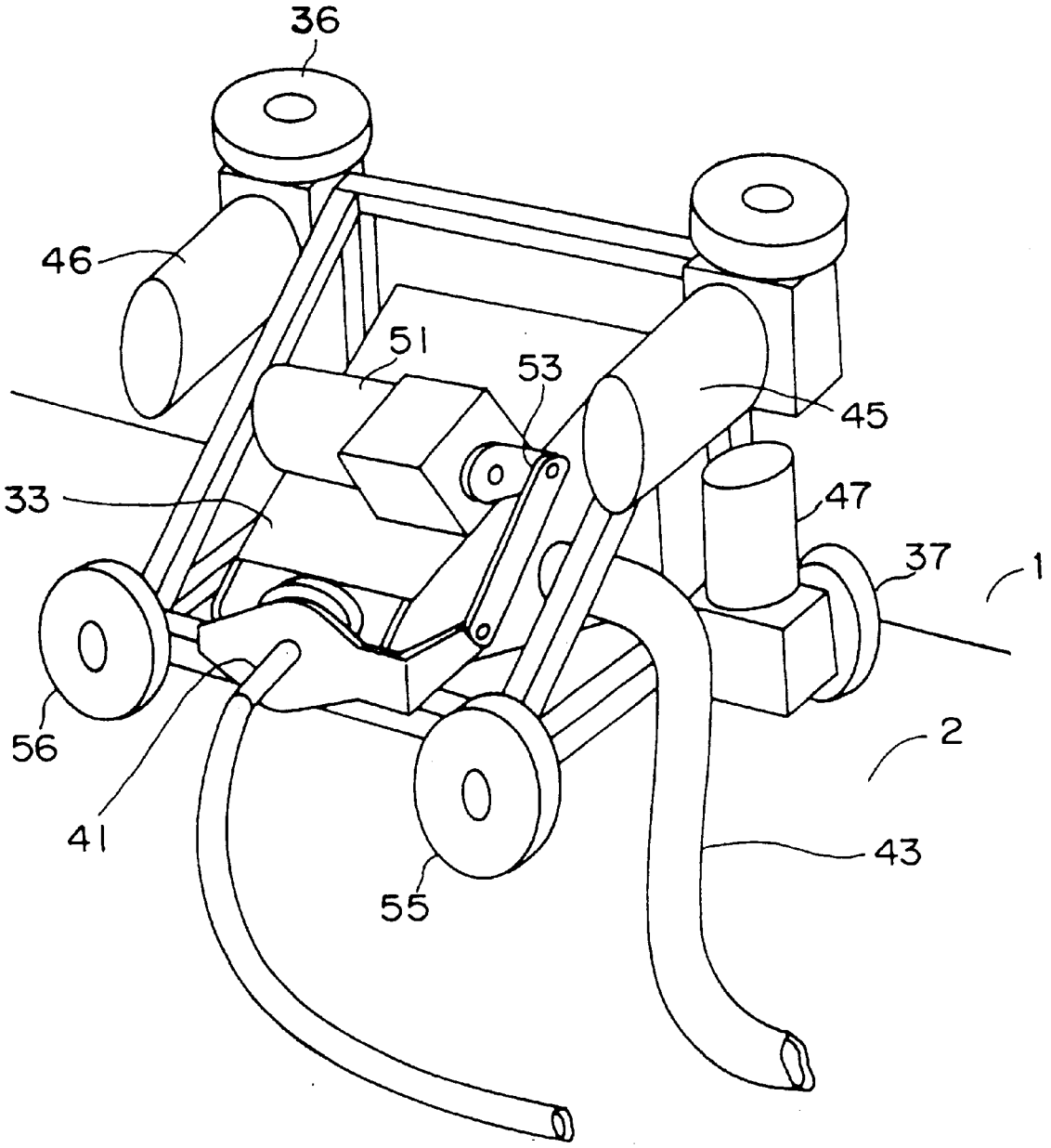
FIG. 9 is a perspective view illustrating a self-drive blast apparatus in accordance with another embodiment of the invention.

In FIG. 9, a blast apparatus in accordance with another embodiment is illustrated. In the blast apparatus, a motor 51 is provided on the outside of a casing 33 and the driving force of the motor is transmitted through a link 53 coupled to the motor 51, to an blast material nozzle 41, which is movable. A portion of the surface of the blast material nozzle 41 is spherical-shaped and a holder which holds and supports the spherical portion is provided and arranged so that the angle of the nozzle can be adjusted. In the embodiment, for the purpose of ensuring the airtightness between the blast material nozzle 41 and the holder, the contact surfaces between both the members are sealed, though not shown specifically. As a result, the direction or angle of the projection of blast material onto wall surfaces can be automatically adjusted, and wider area of the wall surfaces in the space can be blasted and cleaned by altering the projecting direction of the blast material nozzle 41 during the projection of blast material. As auxiliary means for moving the apparatus smoothly, wheel members 55, 56 which have no drive source are provided.

The invention is not limited to the above embodiment but various modifications and the alterations to the design may be made without departing from the spirit and scope of the invention.

As described above, according to the first aspect of the invention, the casing and the seal member attached to the casing define the space between the two wall surfaces intersecting at generally right angles and the casing and, by depressurizing the space, the apparatus is capable of adhering by suction onto the wall surfaces. With the wheel members, the apparatus can be moved along the wall surfaces intersecting at generally right angles. With the blast material projected from the blast material nozzle, a blasting process can be performed on the corner between the wall surfaces. Besides, the projected abrasive material can be retrieved through the depressurization path communicating with the depressurizing apparatus. Accordingly, the apparatus is capable of automatically moving on the corner between the two wall surfaces, and conducting blast cleaning by projecting blast material onto the corner.

Further, according to the second aspect of the invention, the same effects as the first aspect can be attained basically. Besides, with the wheels held in positions generally perpendicular to the corresponding wall surface, the apparatus is capable of moving on the wall surfaces while retaining suction-adhered condition onto the wall surfaces.

Furthermore, according to the third aspect of the invention, the same effects as the first or second aspect can be attained basically. Besides, the blast material projected onto the wall surfaces, the dirt removed by the blast material, and the like can be efficiently retrieved by blowing up the blast material into the space so that the blast material, the dirt, and the like may not collect in the corner between the wall surfaces.

Furthermore, according to the fourth aspect of the invention, the same effects as any one of the first to third aspects can be attained basically. Besides, the blast material nozzle is movable and the angle of the projecting direction can be adjusted; therefore, wider area of the wall surfaces in the space can be blasted and cleaned by projecting blast material while altering the projecting direction.

INDUSTRIAL APPLICABILITY

As described above, the self-drive blast apparatus according to the invention is capable of moving along two wall surfaces intersecting at a given angle, and capable of blast cleaning by projecting blast material onto the wall surfaces; the apparatus can be effectively applied to the blasting work on a corner where two wall surfaces intersect, which work especially involves a difficulty in such works required to be automated as the cleaning of the inner and outer wall surfaces and the conditioning of the substrate surface prior to painting in, for example, a ship, high-rise building, huge tank, or the like.

What is claimed is:

1. A self-drive blast apparatus for blasting a corner area between intersecting first and second wall surfaces, comprising:

a casing having a first end and a second end, the first end having a circumferential flange arranged to mate with the wall surfaces such that an enclosure is defined between the casing and the wall surfaces;

a seal member mounted on the flange for providing an air-tight seal between the flange and the wall surfaces, the seal member comprising a single body with a first seal portion which contacts the first wall surface and a second seal portion which contacts the second wall surface, wherein the seal member forms a closed loop on the circumferential flange of the casing;

a flow path for depressurizing the enclosure, the flow path having a first end communicating with the enclosure and a second end communicable with a depressurizing apparatus;

a nozzle disposed at the second end of the casing, the nozzle for projecting blast material through the enclosure to the wall surfaces;

a moving mechanism for moving the casing along the wall surfaces while the enclosure is being depressurized, the moving mechanism comprising first and second wheel members configured to roll along the first and second wall surfaces, respectively, and a motor for driving each wheel member, the first and second wheel members being held in positions generally perpendicular to the first and second wall surfaces, respectively; and an air vent for allowing air flow to an area in the vicinity of the corner formed by the wall surfaces during depressurization of the enclosure;

wherein the air vent is provided in the seal member.

2. A self-drive blast as claimed in claim 1, further comprising an adjusting mechanism for adjusting the angle of the nozzle to alter the projecting direction of blast material.

* * * * *